US007448175B2

(12) United States Patent
Sourlis

(10) Patent No.: US 7,448,175 B2
(45) Date of Patent: Nov. 11, 2008

(54) DRAINAGE SYSTEM FOR USE IN MASONRY BLOCK CONSTRUCTION

(76) Inventor: Tom Sourlis, 3646 Ridge Rd., Highland, IN (US) 46322

( * ) Notice: Subject to any disclaimer, the term of this patent is extended or adjusted under 35 U.S.C. 154(b) by 553 days.

(21) Appl. No.: 11/072,985

(22) Filed: Mar. 2, 2005

(65) Prior Publication Data

US 2005/0138876 A1 Jun. 30, 2005

Related U.S. Application Data

(63) Continuation-in-part of application No. 10/442,748, filed on May 21, 2003, now Pat. No. 6,912,820.

(51) Int. Cl.
*E04B 1/70* (2006.01)
*E04B 2/14* (2006.01)

(52) U.S. Cl. ..... 52/302.1; 52/169.5; 52/302.4; 52/302.6

(58) Field of Classification Search ..... 52/169.5, 52/302.1, 302.3, 302.4, 302.6
See application file for complete search history.

(56) References Cited

U.S. PATENT DOCUMENTS

| | | | |
|---|---|---|---|
| 835,669 | A | 11/1906 | Eckley |
| 1,746,816 | A | 2/1930 | Boes |
| 1,927,881 | A | 9/1933 | Wetmore |
| 2,061,633 | A | 11/1936 | Muller |
| 2,657,570 | A | 11/1953 | Moore |
| 2,934,931 | A | 5/1960 | Johnson et al. |
| 3,241,272 | A | 3/1966 | Edwards |
| 3,293,810 | A | 12/1966 | Cox et al. |
| 3,429,084 | A | 2/1969 | Brewer |
| 3,668,829 | A | 6/1972 | Nelson |
| 4,253,285 | A | 3/1981 | Enright |
| 4,272,931 | A | 6/1981 | Stanizzo |
| 4,375,143 | A | 3/1983 | Godlewski |
| 4,612,742 | A | 9/1986 | Bevilacqua |
| 4,907,385 | A | 3/1990 | Biodrowski |
| 4,910,931 | A | 3/1990 | Pardue, Jr. |
| 5,115,614 | A | 5/1992 | McGrath |
| 5,120,162 | A | 6/1992 | Parker |
| 5,230,189 | A | 7/1993 | Sourlis |
| 5,274,968 | A | 1/1994 | Pardo |
| 5,343,661 | A | 9/1994 | Sourlis |
| 5,596,857 | A | 1/1997 | Besche |
| 5,870,864 | A | 2/1999 | Snyder et al. |
| 5,937,594 | A | 8/1999 | Sourlis |
| 5,946,870 | A | 9/1999 | Bifano et al. |
| 6,000,186 | A | 12/1999 | Fielding et al. |
| 6,023,892 | A | 2/2000 | Sourlis |

(Continued)

FOREIGN PATENT DOCUMENTS

| | | | |
|---|---|---|---|
| WO | 00/40809 | A1 | 7/2000 |

*Primary Examiner*—Robert Canfield
(74) *Attorney, Agent, or Firm*—McDonnell Boehnen Hulbert & Berghoff LLP

(57) ABSTRACT

A drainage system for use in concrete masonry unit (CMU) wall construction comprises a tray unit of a size corresponding to size of CMUs, to be received beneath a course of CMUs, in use. The tray unit comprises opposite side flanges to abut a superjacent CMU and supporting a pan therebelow. The pan may be angled from back to front and from side edges to a middle portion thereof to urge water toward a front middle portion of the tray.

12 Claims, 5 Drawing Sheets

U.S. PATENT DOCUMENTS

| | | | | |
|---|---|---|---|---|
| RE36,676 | E | 5/2000 | Sourlis | |
| 6,202,366 | B1 | 3/2001 | Snyder et al. | |
| 6,308,470 | B1 | 10/2001 | Durkovic | |
| 6,564,520 | B1 * | 5/2003 | Starke et al. | 52/302.1 |
| 6,912,820 | B2 * | 7/2005 | Sourlis | 52/302.1 |
| 7,216,460 | B2 * | 5/2007 | Sourlis | 52/169.5 |

* cited by examiner

DRAINAGE SYSTEM FOR USE IN MASONRY BLOCK CONSTRUCTION

This application is a continuation-in-part of Ser. No. 10/442,748, filed on May 21, 2003, now U.S. Pat. No. 6,912, 820.

FIELD OF THE INVENTION

This invention relates to concrete masonry unit wall construction and, more particularly, to a drainage system therefor.

BACKGROUND OF THE INVENTION

Single wythe masonry walls are constructed using concrete masonry units (CMUs). CMUs are sometimes referred to as cinder blocks. A CMU consists of a hollow rectangular building block typically having a central web providing two vertical cores or cavities. It will be understood that a CMU can have any number of configurations including one wherein only a single core is present. In single wythe masonry wall construction a foundation is formed, typically of concrete. The wall is formed by laying the CMUs in alternating fashion in multiple courses depending on the height of the wall. Owing to the construction, the vertical cores of CMUs are aligned to provide a continuous channel from the top of the wall down to the foundation. Mortar is used in joints to join the CMUs.

Cracks in the CMUs can allow water to enter the cores. Moisture can also condense in the cores under changing temperatures. Either way, water may collect in the cores in the CMUs.

The presence of moisture in the cores is undesirable for a number of reasons. First, the trapped moisture can degrade the structure. Second, the presence of water under freezing temperatures may also cause cracks in the wall when water expands as it freezes. Trapped water in the cores in the CMUs may cause the CMUs to become discolored, and may even migrate into the dwelling. Another hazard of failing to deal with water in the CMUs is the formation of mold. It is widely accepted that mold growth can damage a building or render the building uninhabitable for various reasons. These reasons include a dangerous situation where the mold growth produces toxins and/or allergens sufficient to sicken inhabitants.

To overcome the problems associated with water trapped within the CMU cores, weep holes are commonly included along the base of the outer side of the CMUs in the lowermost course. The weep holes allow water to pass from the core to drain outside the wall structure. A flashing disposed in the core directs the collected water toward the weep holes.

During construction of a single wythe masonry wall, excess mortar and other debris can and does fall into the cores. When the CMUs are stacked during the erection of the wall, for example, mortar droppings are squeezed into cores within the CMUs. The excess mortar material, as well as other debris, such as insulation, drops to the base of the core, and can block weep holes.

One known solution is to construct a CMU drainage course consisting of two wythes separated by a cavity sized to accommodate through wall flashing and blocks of water permeable material. This solution uses different style concrete blocks in the drainage course.

Another known solution, shown in U.S. Pat. No. 6,202, 366, uses a collection pan under each CMU core of a selected course to collect water in the core. A weep channel on the pan drains the water to the exterior of the wall. This solution requires a collection pan for each core. Also, each pan must be aligned prior to applying mortar so that once a subsequent course is laid each pan is properly aligned with the CMU.

The present invention is directed to solving one or more of the problems discussed above, in a novel and simple manner.

SUMMARY OF THE INVENTION

In accordance with the invention, there is provided a drainage system for use in concrete masonry unit (CMU) wall construction. The CMU may have one or more cores or cavities defined therein.

Broadly, the drainage system comprises a tray unit of a size corresponding to size of CMUs, to be received beneath a course of CMUs, in use. The tray unit comprises opposite side flanges to abut a superjacent CMU and supporting a pan therebelow. A strip of water permeable material is attached to an upper surface of the pan and extends transversely beyond a front edge of the pan. A block of water permeable material is positioned above the pan and extends upwardly into a hollow core of a CMU. The water permeable material of the strip and the block has porosity sufficient to permit water to pass therethrough but substantially insufficient to permit mortar and debris to pass therethrough so that water in a hollow core of a CMU drains through the strip.

It is a feature of the invention to provide an adhesive layer on the opposite side flanges to adhere to a CMU. The adhesive may be on an upper surface of the opposite side flanges to adhere to a superjacent CMU.

It is another feature of the invention that the pan is sloped downwardly toward the front edge and in a preferred embodiment a slope is additionally provided which is inclined from the outer edges of the pan downwardly to the middle of the pan. In this fashion, a compound slope is provided to the pan to urge water to the middle of the pan and, at the same time, to the front of the pan and thus, out of the front of the tray and from the core of an adjacent CMU.

It is still another feature of the invention to provide front and rear flanges extending between the side flanges to support the pan. The front flange includes a notch receiving the strip. The strip extends forwardly of the front flange.

It is still another feature of the invention that the water permeable material is a non-water absorbent randomly oriented fibrous material.

It is still a further feature of the invention that the block is T-shaped having a top part wider than a CMU core and a bottom part narrower than a CMU core.

It is still another feature of the invention that the block is taller than a CMU so that the top part bends to conform to a CMU core and the bottom part extends horizontally to cover a portion of the strip disposed in a CMU core.

There is disclosed in accordance with another aspect of the invention a drainage system for use in CMU wall construction, each CMU including a pair of hollow cores. The drainage system comprises a generally rectangular tray unit of a size corresponding to size of CMUs, to be received beneath a course of CMUs, in use. The tray unit comprises a perimeter flange, a web flange connected transversely centrally within the perimeter flange, the flanges to abut a superjacent CMU, and a pair of pans each supported between the perimeter flange and web flange and each on opposite sides of the web flange. Each of a pair of strips of water permeable material is attached to an upper surface of one of the pans and extending transversely beyond a front of the perimeter flange. A pair of blocks of water permeable material is positioned above the pans and extending upwardly into hollow cores of a CMU, in use.

There is disclosed in accordance with a further aspect of the invention a drainage system for use in CMU wall construction comprising an elongate tray element of one piece construction to be received beneath a course of CMUs, in use, including a plurality of aligned, generally rectangular tray units each of a size corresponding to size of cores. Each tray unit comprises a perimeter flange to abut a superjacent CMU, and a pan supported within the perimeter flange. A plurality of strips of water permeable material are each attached to an upper surface of one of the pans and extend transversely beyond a front of the perimeter flange.

It is a feature of the invention that each perimeter flange comprises front and rear flanges extending between opposite side flanges to support the pans. The front flange includes a notch receiving the strip.

It is still another feature of the invention that at least one side flange of each tray unit adjoins a side flange of an adjacent tray unit.

It is still a further feature of the invention that adjoining side flanges are separated by a score line.

Further features and advantages of the invention will be readily apparent from the specification and from the drawings.

DETAILED DESCRIPTION OF THE INVENTION

Figure 1:
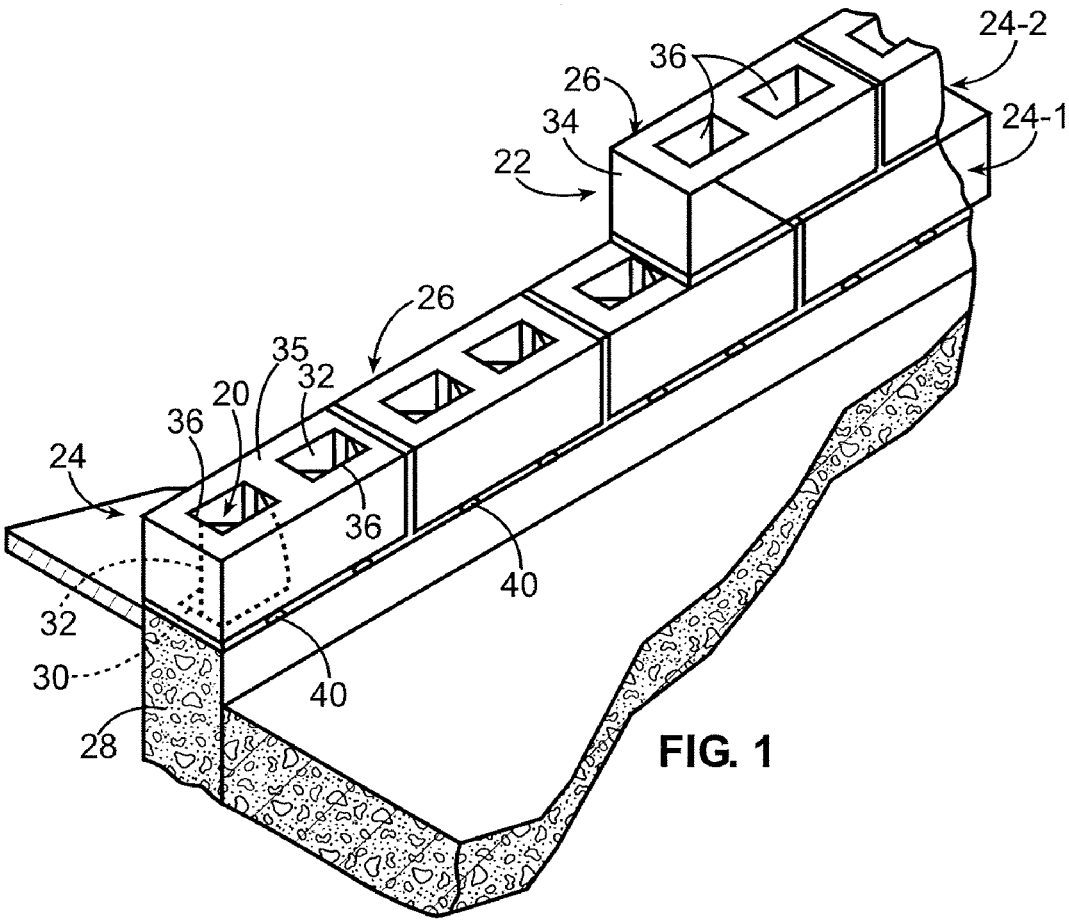
FIG. 1 is an exterior perspective view of an embodiment of a drainage system in accordance with the invention used in a single wythe masonry wall formed by courses of concrete masonry units (CMUs)

Referring to FIG. 1, a drainage system 20 is illustrated in connection with concrete masonry unit (CMU) wall construction. In the illustrated embodiment of the invention, the drainage system 20 is used in a single wythe masonry wall construction 22 formed by courses 24 of CMUs 26. The wall construction 22 is used on a building structure including a foundation wall 28. In the illustrated embodiment of the invention, the foundation wall 28 comprises a concrete wall. The foundation wall could be of block construction, as will be apparent to those skilled in the art.

Figure 10:
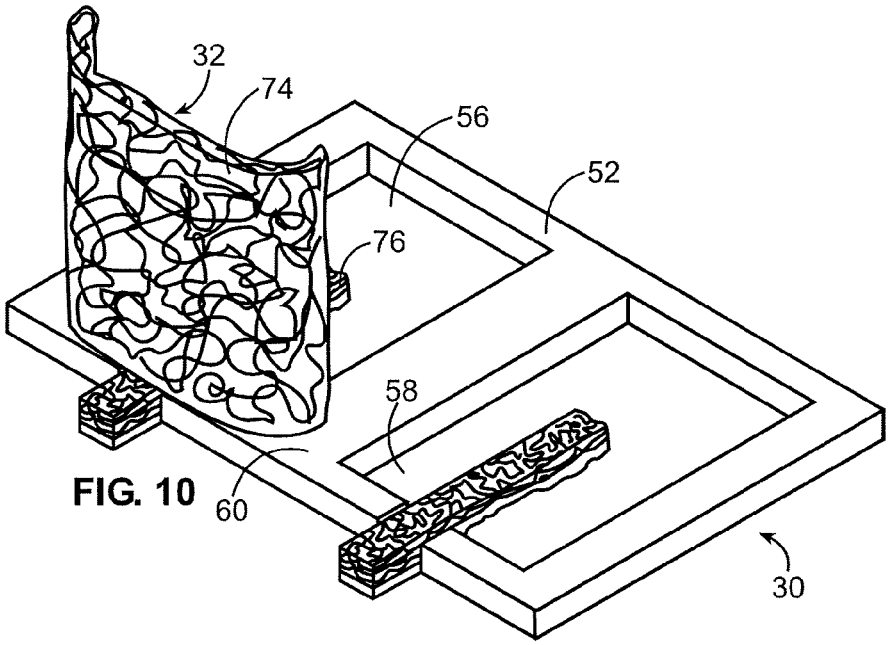
FIG. 10 is a perspective view, with a CMU removed for clarity, illustrating relationship between the block and the tray in accordance with the invention.

Referring also to FIG. 10, the drainage system 20 comprises a tray 30 and a pair of blocks 32 of water permeable material.

CMUs 26 most typically have a nominal height of eight inches, a nominal length of sixteen inches and come in nominal widths of eight, ten or twelve inches. Actual sizes are about ⅜ inches less to allow for a ⅜-inch mortar joint. The CMU 26 comprises a hollow concrete block 34 having a web 35 to provide a pair of vertically extending hollow cores or cavities 36 therethrough. The hollow cores or cavities 36 are typically about five inches square. In conventional single wythe masonry wall construction, a first course 24-1 of CMUs 26 is secured to the foundation wall 28 with a layer of mortar. Mortar is also provided between adjacent CMUs 26. A layer of mortar is then placed upon the first course 24-1 and the second course 24-2 is laid on the first course 24-1. Again, mortar is provided between each CMU 26. The CMUs 26 in each course are typically offset from one another as illustrated in FIG. 1. As a result, the vertical cores 36 in any course 24 are aligned with the vertical cores 36 in other courses 24 to provide a continuous channel from the top of the wall down to the foundation wall 28, as is well known.

Figure 2:
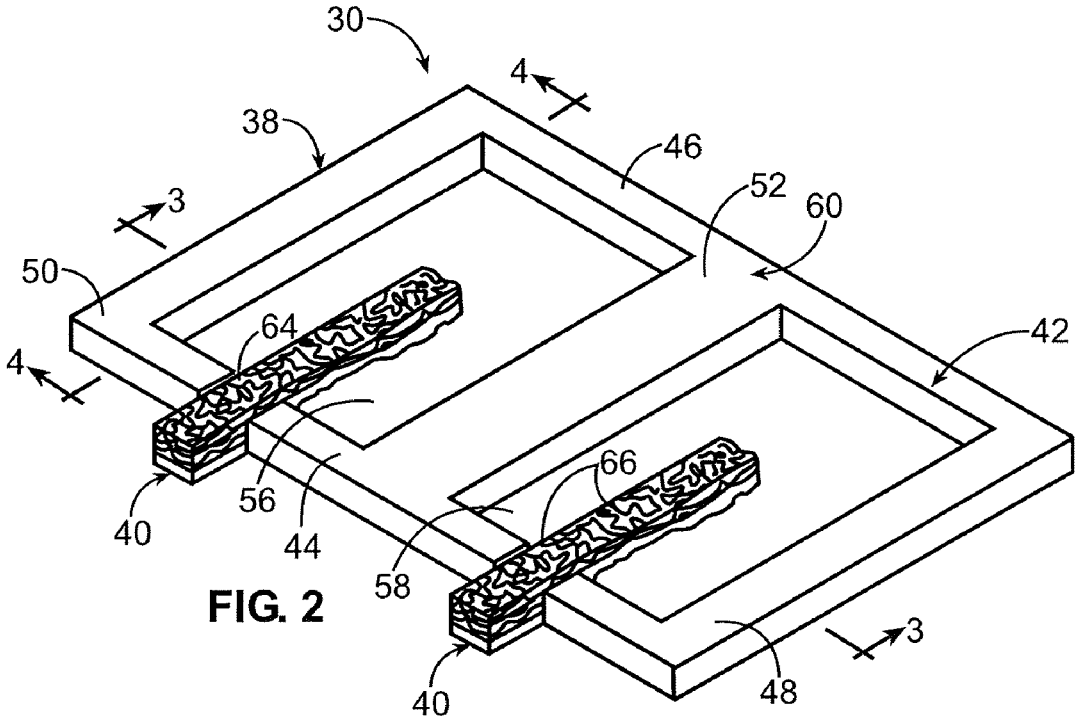
FIG. 2 is a perspective view of a tray of the drainage system of FIG. 1.
Figure 3:
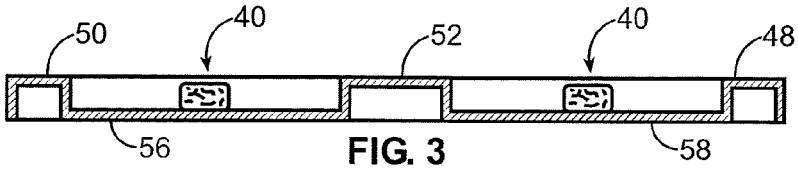
FIG. 3 is a sectional view taken along the line 3-3 of FIG. 2.
Figure 4:
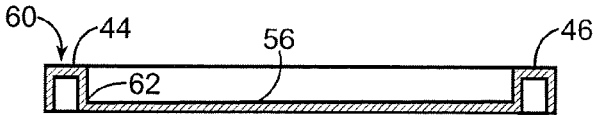
FIG. 4 is a sectional view taken along the line 4-4 of FIG. 2.

Referring to FIGS. 2-4, the tray 30 comprises a tray unit 38 and a pair of strips 40 of water permeable material. The tray unit 38 is of one piece molded plastic construction and has a length and a width less than that of a CMU so that it can be set in mortar and the mortar will set up and secure the tray unit 38 in position. For example, the length of the tray unit 38 may be on the order of twelve inches and the width of the tray unit 38 may be on the order of six inches for an eight inch wide CMU.

The tray unit 38 comprises a peripheral flange 42 formed by a front flange 44, a rear flange 46, a right side flange 48 and an opposite left side flange 50. A web flange 52 is connected transversely, centrally within the perimeter flange 42 and in particular extends from a center of the rear flange 46 to a center of the front flange 44. The perimeter flange 42 and the web flange 52 may be U-shaped in cross section, as shown in FIGS. 3 and 4, and open downwardly. A pair of pans 56 and 58 is supported between the perimeter flange 42 and the web flange 52 each on opposite sides of the web flange 52. Particularly, the first pan 56 is supported in an area bound by the left side flange 50, the front flange 44, the web flange 52 and the rear flange 46. Similarly, the right pan 48 is supported in an area bound by the web flange 52, the front flange 44, the right side flange 48, and the rear flange 46. The pans 56 and 58 are generally rectangular in shape and of a size at least as large a shape of the hollow cores 36. The perimeter flange 42 and web flange 52 define an upper surface 60. In the embodiment of FIGS. 2-4, the upper surface 60 is planar and the pans 56 and 58 are likewise planar and parallel to the upper surface 60.

Figure 4A:
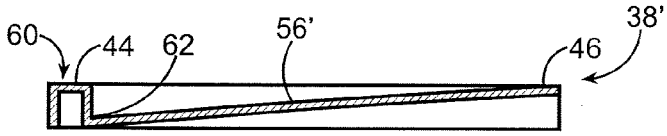
FIG. 4A is a sectional view, similar to FIG. 4, of a tray according to an alternative embodiment of the invention.

FIG. 4A illustrates a tray unit 38' in accordance with an alternative embodiment of the invention. This embodiment differs in that the pans, including a left pan 56', are sloped from the rear flange 46 toward the front flange 44. Indeed, depending on the slope, the rear flange 46 may even be eliminated. The sloped pans enhance drainage toward a front edge 62 of the pan 56' and thus the front flange 44 to enhance drainage. The pan 56' could also be sloped from the sides toward the strip 40.

In the illustrated embodiment of the invention, the tray unit 38 has a uniform wall thickness on the order of 1/16 inch. Alternatively, the flanges could be solid plastic.

The front flange 44 includes a pair of notches 64 and 66. The notch 64 is associated with the left pan 56 and is centered between the left side flange 50 and the web flange 52. Similarly, the right notch 66 is associated with the right pan 58 and is centered between the web flange 52 and the right side flange 48.

The strips 40 are of a water permeable material having a thickness in the range of about 1/8 inch to 1/2 inch with 1/4 inch being typical. The strips 40 are adhered in any known manner to the pans 56 and 58 and extend transversely beyond the front edge 62 of the pans 56 and 58 and also beyond front flange 44. The strips 40 function to permit water to pass therethrough and to substantially prevent mortar and other debris from passing therethrough. The material is preferably a non-absorbent water-permeable, fibrous mesh material formed with circuitous (non-linear) pathways. The material is preferably a mass of random filament-type plastic fibers. The strip may also include an outer layer of backing material. The backing material may be a finely woven paper like material, which will pass water but not fine debris, such as vermiculite or the like. Overall, the material is sufficient to catch and support mortar and debris without significant collapse, but allow water to pass freely therethrough. The strips 40 may be secured with a suitable adhesive or molded in situ with the tray unit 38.

Figure 5:
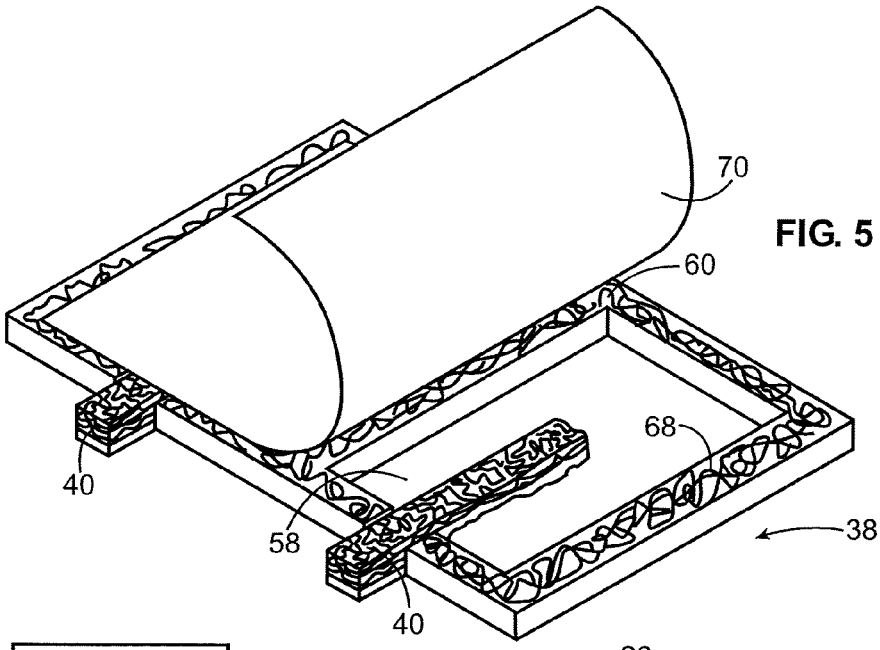
FIG. 5 is a perspective view, similar to FIG. 2, illustrating the tray with a peel and stick adhesive layer.

Referring to FIG. 5, the tray unit 38 includes an adhesive layer 68 on the upper surface 60. The adhesive layer 68 is initially covered by a removable film 70 to provide a peel and stick configuration. In the illustrated embodiment of the invention, the adhesive layer 68 covers the entire upper surface 60. Alternatively, the adhesive layer could be provided only on the side flanges 48 and 50 and the web flange 52, as necessary or desired. Likewise, the adhesive layer could be provided on a bottom surface, particularly when used with solid flanges.

Figure 6:
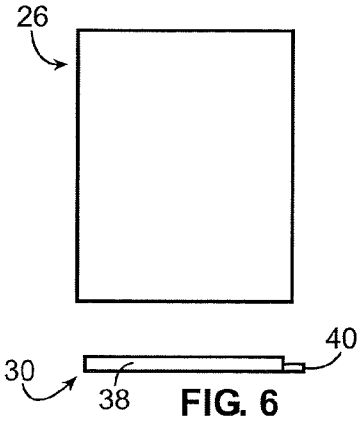
FIG. 6 is a side elevation exploded view illustrating the tray of FIG. 2 prior to attachment to a CMU.
Figure 7:
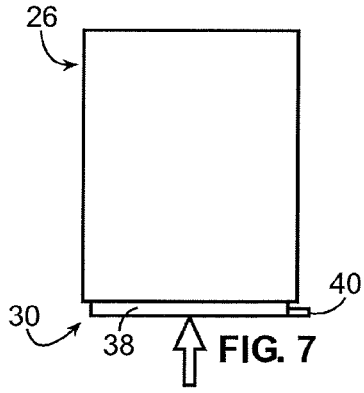
FIG. 7 is a side elevation view, similar to FIG. 6, illustrating the tray attached to the CMU.

To install the tray 30, it is positioned below a CMU 26, as illustrated in FIG. 6, after removal of the protective sheet 70. Thereafter, it is pressed against the bottom of the CMU 26 so that the adhesive layer 68, see FIG. 5, causes the tray unit 38 to adhere directly to the CMU 26. This allows the tray 30 to be properly aligned with the CMU 26 so that the pans 56 and 58 are positioned directly below the cores 36. As is apparent, the tray 30 could be turned upside down and secured to an upside down CMU which is then turned over to be laid on the foundation wall 28. More particularly, a layer of mortar is applied to the top of the foundation wall 28 in a conventional manner and the CMU 26 with the tray 30 installed thereon is laid in the mortar for to set up in a conventional manner. Thereafter, the strips 40 extend outwardly of the CMUs 26, as generally illustrated in FIG. 1. As illustrated, the strips 40 are of a length to extend forwardly of the CMU 26 and then optionally be cut off after the mortar sets or be provided with a score line to be broken off.

Figure 8:
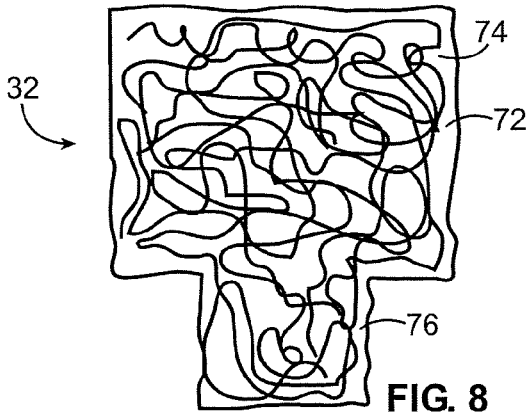
FIG. 8 is an elevation view of a block of water permeable material in a static state used in the drainage system of FIG. 1.
Figure 9:
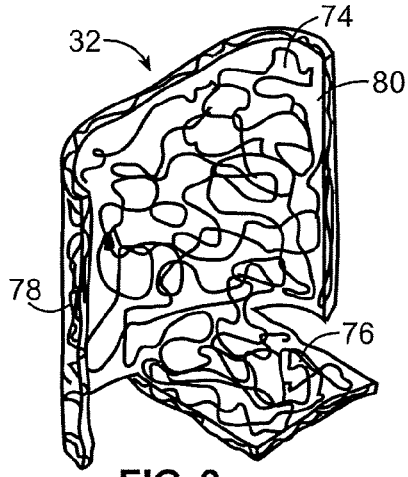
FIG. 9 is a perspective view of the block of FIG. 8 bent to conform to walls of a CMU hollow core.

Referring to FIG. 8, the block 32 comprises a T-shaped sheet 72 of water permeable material, similar to material of the strips 40. The sheet 72 has a thickness in the range of about 1/8 inch to 1/2 inch with 1/4 inch being typical. The sheet 72 has a top part 74 wider than a CMU core 36 and a bottom part 76 narrower than a CMU core 36. For example, with a CMU having a 5×5 inch core, the top part 74 might be about six to eight inches across and about seven inches tall, while the bottom part 76 might be on the order of four inches across and four inches tall. The block 32 is then stuffed in a core 36 of the first course 24-1 by bending the bottom part 76 so that it extends horizontally and thus perpendicular to the top part 74 and then curving opposite ends 78 and 80 of the top part 74 to conform to the walls of the core 36. As a result, the curve of the top part 74 gives stability to the mesh material to withstand impact of falling mortar.

The proper type of mesh, as described above, will provide a prickly adhesion to the porous walls of the CMUs 26. The horizontal bottom part 76 covers the drainage strip 40 to protect it from being plugged by mortar droppings or granular or foam insulation.

FIG. 10 illustrates a tray unit 30 with one block 32 installed over the left pan 56. For clarity, the CMU 26 is not shown in FIG. 10. As is apparent, the block top portion 74 will be supported above or by the tray unit upper surface 60. The bottom portion 76 could be resting directly atop the strip 40 or be supported slightly above the strip 40, as necessary or desired.

As described, the tray 30 is adapted to function with a dual core CMU, such as a CMU 26. The tray unit 38 could be provided with a single pan with two strips 40 as by eliminating the web flange 52 for use with dual cores, or could be provided in half the size with only a single pan for use with a smaller CMU having only a single core.

Figure 11:
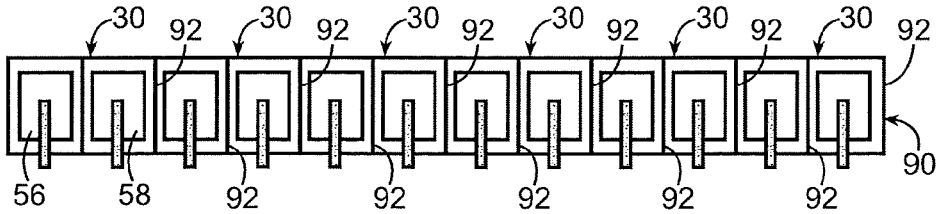
FIG. 11 is a plan view of a tray element in accordance with an alternative embodiment of the invention comprising a plurality of trays.

Referring to FIG. 11, a tray element 90 according to an alternative embodiment of the invention is illustrated. The tray unit 90 comprises a plurality of trays 30 formed together of one piece construction to be received beneath a plurality of CMUs 26 in a course. In the illustrated embodiment of the invention, the tray element 90 comprises six trays 30 integrally joined together so that at least one side flange of each tray 30 adjoins a side flange of an adjacent tray. A score line 92 could be provided between adjacent trays 30 for separability in the field if fewer than six trays 30 are required. Also, a score line 92 could be provided between pans 56 and 58 of each tray 30 in the event that an odd number of cores are present. In all other respects, the trays 30 are as described above relative to FIGS. 2-5. As is apparent, the tray element 90 could have more or less than six trays 30. After installation, a block 32 of water permeable material will be positioned above the tray element 90 at each core 36, as described above.

Figure 12:
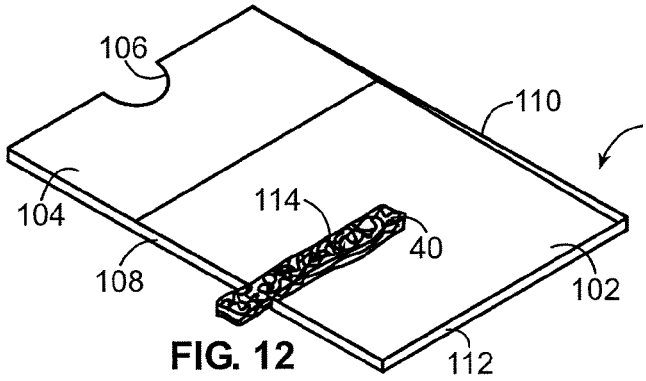
FIG. 12 is a perspective view of another embodiment of a tray in accordance with the invention to accommodate a rebar.

Referring to FIG. 12, a tray 100 is adapted to accommodate rebar in a reinforced wall. The tray unit 100 comprises a pan 102 connected to a left side sloped end wall 104. The end wall 104 includes a semicircular notch 106 to receive a rebar. The notch 106 should be sized larger than the rebar to allow field placement of the tray 100. Front and rear flanges 108 and 110, respectively, extend across the pan 102 and the end wall 104 and are connected by a right side flange 112. A notch 114 in the front flange 114 receives a strip 40 of water permeable material, as above. As is apparent, the end wall 104 and side flange 112 could be reversed for installation on the opposite side of the rebar.

Figure 13:
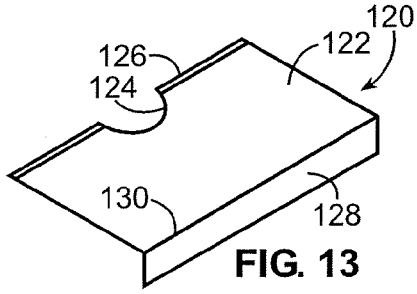
FIG. 13 is a perspective view of an adapter used with the trays in accordance with the invention to accommodate rebar.

FIG. 13 illustrates an adapter 120 for use with the tray 30 of FIG. 2 to accommodate rebar. The adapter 120 comprises a plate 122 having a notch 124 on one side edge 126 and a downwardly depending lip 128 on an opposite edge 130. The lip 128 can hook over a side flange 48 or 50 so that the notched edge 126 is away form the pan 58 or 56.

Though the block 32 is described as a T-shaped sheet element, other configurations for the block 32 could also be used. These blocks include triangular elements, cylindrical elements, as well as other shapes. Such shapes and the water permeable material are described in applicant's pending application Ser. No. 10/393,689, filed Mar. 21, 2003, the specification of which is hereby incorporated by reference herein.

Figure 14:
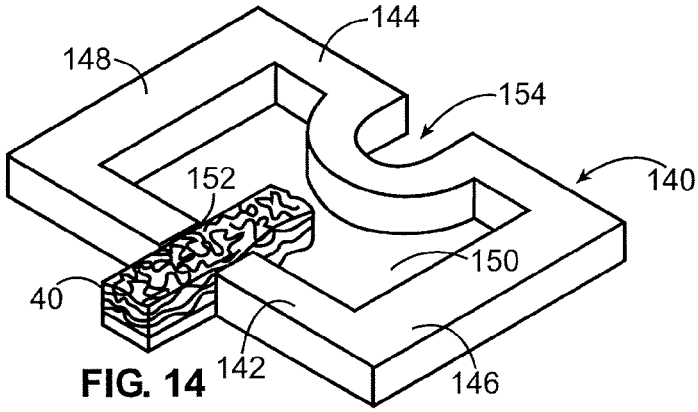
FIG. 14 is a perspective view of yet another embodiment of a tray in accordance with the invention.

Referring to FIG. 14, a tray 140 is adapted to accommodate rebar. The tray has a width of about one half the width of a CMU. The tray has a front flange 142, a rear flange 144, a right side flange 146, and a left side flange 148. A pan 150 is supported between the flanges 142, 144, 146, and 148. A strip of the water permeable material 40 is received in a notch 152 in the front flange 142. The rear flange 144 is provided with a notch 154 that is sized for receipt of the rebar.

Figure 15:
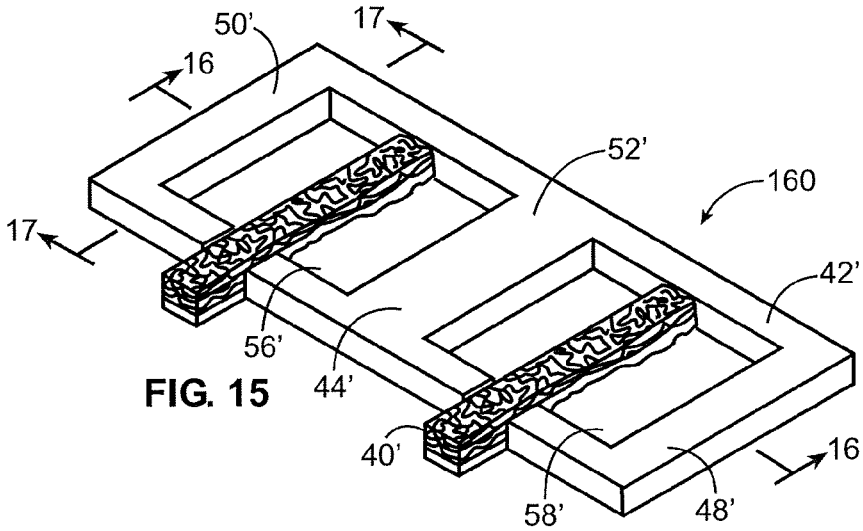
FIG. 15 is a perspective view of an alternative embodiment of a tray of the drainage system of FIG. 1.
Figure 16:
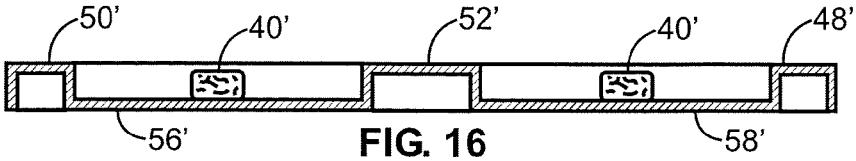
FIG. 16 is a sectional view taken along line 16-16 in FIG. 15.
Figure 17:
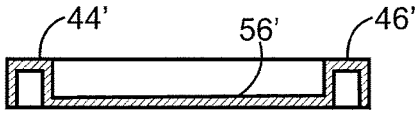
FIG. 17 is a sectional view taken along line 17-17 in FIG. 15.

Referring to FIGS. 15-17, a tray 160 is provided that is of reduced width so that it extends from the front edge of a CMU inwardly a distance of at least about one inch past the inside face of the CMU. Tray 160 is of a similar configuration and function as tray 30 except that it is of reduced width. The same numbers with a prime sign has been used to design corresponding elements. Since most or all of any water has been found to fall down the front inside face of the CMU's, it has been determined that it is not necessary for the tray to extend across the entire width of the CMU. Because of the width reduction, rebar does not interfere with the tray 160.

Figure 17A:
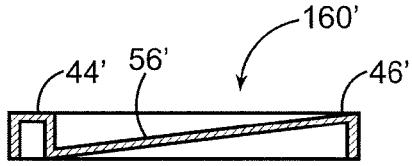
FIG. 17A is a sectional view, similar to FIG. 17, of a tray according to a further alternative embodiment of the invention.

FIG. 17A illustrates a tray 160' in accordance with a further alternative embodiment of the invention. This embodiment differs in that the pans are sloped from the rear flange 46' toward the front flange 44'. The shortening of the width of the tray 160' may cause a steeper angle of the pan and improves drainage. The rear flange 46' may be eliminated. Additionally, the rear edge of the tray 160' can be cut in the field to accommodate oddly positioned rebar.

Figure 18:
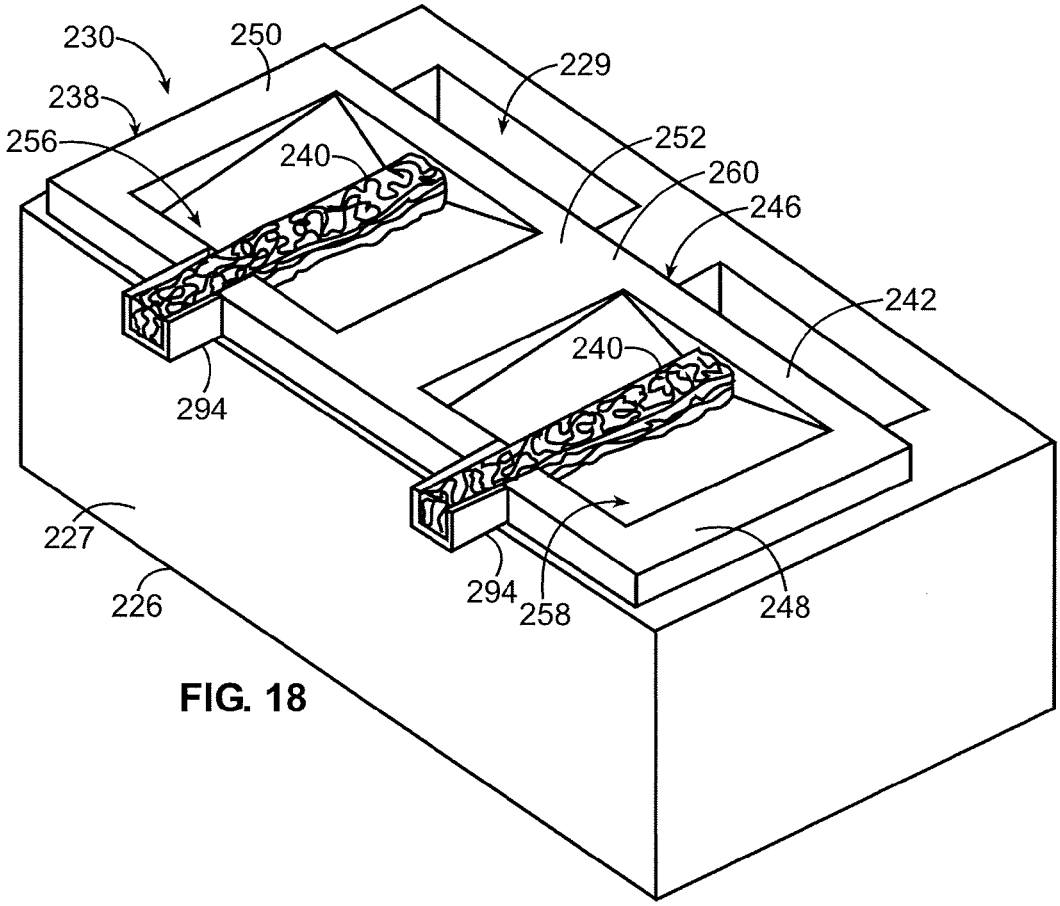
FIG. 18 is a perspective view of yet another embodiment of a tray in accordance with the invention.

FIG. 18 illustrates yet another preferred embodiment of the present invention. In particular, tray 230 comprises a tray unit 238 and a pair of strips 240 of water permeable material. The tray unit 238 may be constructed of a one piece molded plastic construction and has length less than that of a CMU so that it can be set in mortar and the mortar will set up and secure the tray unit 238 in position. For example, the length of the tray unit 238 may be on the order of twelve inches. The width may be reduced like the tray shown in FIG. 15 so that it extends from the front edge 227 of a CMU 226 inwardly a distance of at least about one inch past the inside face of the CMU, but less than the entire CMU cavity 229 so the tray 238 extends a width less than the entire width of the CMU.

The tray unit 238 comprises a peripheral flange 242 formed by a front flange 244, a rear flange 246, a right side flange 248 and an opposite left side flange 250. A web flange 252 is connected transversely, centrally within the perimeter flange 242 and in particular extends from a center of the rear flange 246 to a center of the front flange 244. The perimeter flange 242 and the web flange 252 may be U-shaped in cross section, as shown in FIGS. 3 and 4, and open downwardly. A pair of pans 256 and 258 is supported between the perimeter flange 242 and the web flange 252 each on opposite sides of the web flange 252. In this embodiment, each of the strips 240 is positioned on a horizontal portion (not shown) of each of pans 256, 258.

The first pan 256 is supported in an area bound by the left side flange 250, the front flange 244, the web flange 252 and the rear flange 246. Similarly, the right pan 258 is supported in an area bound by the web flange 252, the front flange 244, the right side flange 248, and the rear flange 246. The pans 256 and 258 may be generally rectangular in shape and of a size at least as large a shape of the hollow cores 36.

The perimeter flange 242 and web flange 252 define an upper surface 260. In the embodiment of FIG. 18, the upper surface 260 is planar and the pans 256 and 258 are non-planar and non-parallel to the upper surface 260. Specifically, the pans 256 and 258 are constructed so as to direct water toward the center and front of each respective pan. Each pan 256, 258 slopes from an outside downwardly to respective strips 240 and additionally, downwardly from back to front. The present invention contemplates any combination of side to middle or side-to-side or back to front slopes for the pans 256, 258, with the objective of encouraging drainage of water on the pan toward the strips 240 and to exit the tray 230.

Another feature of the tray 230 in FIG. 18 is a spout or channel 294, which extends horizontally from the front flange 244. Each spout 294 is level with the pan 256, 258 such that water draining off of the pan or along the strip 240 is carried out from the tray 230. The spout 294 also functions to support strip 240.

Figure 19:
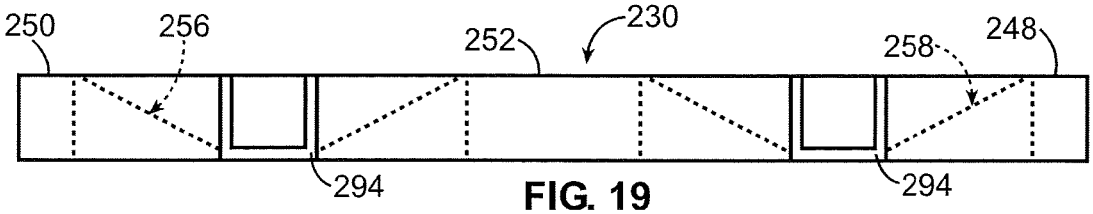
FIG. 19 is a front view of the tray of FIG. 18.

FIG. 19 illustrates the tray 230 of FIG. 18 in a front view. The tray 230 is shown with right flange 248 and web flange 252 supporting pan 258 therebetween. Similarly, left flange 250 and web flange 252 support pan 256 therebetween. Spout 294 permits water falling on pans 256, 258 to exit from within tray 230. Each pan is inclined from back to front and from outer edges to a middle thereof to urge water toward a respective strip 240, and spout 294 and out from the tray 230.

Thus, in accordance with embodiments of the invention, there is provided a drainage system including a tray unit including a pan with a strip of water permeable material attached to an upper surface of the pan and a block of water permeable material position above the pan. The pan may be angled to urge the egress of water therefrom and away from a wall constructed of a plurality of masonry units. Each strip may be supported by a channel extending from a front portion of a respective tray. The channel may be angled downwardly to assist in the removal of water from the strip and pan.

I claim:

1. A drainage system for use in concrete masonry unit (CMU) wall construction, comprising:

a masonry wall including a plurality of CMUs, each CMU including at least one cavity having a cavity width and the cavity having an inside face adjacent an outside face of the masonry wall;

a tray unit sized and shaped to be received beneath one or more CMUs, in use, the tray unit including a peripheral flange and having a tray width sufficient to extend past the inside face of the one or more CMUs but less than the entire cavity width;

a pan supported by the peripheral flange; and a strip of water permeable material attached to an upper surface of the pan and extending transversely beyond a front edge of the pan, wherein the pan is inclined downwardly toward the strip and the water permeable material of the strip has a porosity sufficient to permit water to pass therethrough but substantially insufficient to permit mortar and debris to pass therethrough so that water in a hollow core of the CMU drains through the strip.

2. The drainage system of claim 1, further including a block of water permeable material, the block being positioned above the pan and extending upwardly into a hollow core of a CMU, in use, the water permeable material of the block having a porosity sufficient to permit water to pass therethrough but substantially insufficient to permit mortar and debris to pass therethrough so that water in the hollow core of the CMU drains through the strip.

3. The drainage system of claim 1, wherein the flange includes a front flange portion and a rear flange portion extending between opposite side flanges to support the pan, the front flange portion including a notch for receiving the strip.

4. The drainage system of claim 3 wherein the pan is sloped downwardly toward the front flange portion.

5. The drainage system of claim 1 further comprising an adhesive layer on the opposite side flanges to adhere to a CMU.

6. The drainage system of claim 4 wherein the strip extends forwardly of the front flange portion.

7. The drainage system of claim 6 wherein the front flange portion includes a support member sized and shaped to support the extending portion of the strip.

8. The drainage system of claim 7 wherein the support member is a rectangular member positioned under the notch.

9. The drainage system of claim 7 wherein the support member is a U-shaped channel.

10. The drainage system of claim 1 wherein the water permeable material is a non-water absorbent randomly oriented fibrous material.

11. The drainage system of claim 2 wherein the block is T shaped having a top part wider than a CMU core and a bottom part narrower than a CMU core.

12. The drainage system of claim 11 wherein the block is taller than a CMU so that the top part bends to conform to a CMU core and the bottom part extends horizontally to cover a portion of the strip disposed in a CMU core.

* * * * *